US006050409A

United States Patent [19]

Delbeck et al.

[11] Patent Number: 6,050,409

[45] Date of Patent: Apr. 18, 2000

[54] STORAGE DEVICE FOR SCREWDRIVER BITS OR THE LIKE AND CHUCK THEREFOR

[76] Inventors: Klaus Delbeck, An der Bleiche 17, D-47638 Straelen; Ralf Möller, Friedrichsallee 11, D-42117 Wuppertal, both of Germany

[21] Appl. No.: 09/194,482

[22] PCT Filed: May 15, 1997

[86] PCT No.: PCT/EP97/02482

§ 371 Date: Mar. 26, 1999

§ 102(e) Date: Mar. 26, 1999

[87] PCT Pub. No.: WO97/44163

PCT Pub. Date: Nov. 27, 1997

[30] Foreign Application Priority Data

May 22, 1996 [DE] Germany ..... 196 20 566

[51] Int. Cl.[7] ..... B65D 85/28

[52] U.S. Cl. ..... 206/375; 206/379

[58] Field of Search ..... 206/349, 372, 206/373, 376–379; 211/70.6, 69

[56] References Cited

U.S. PATENT DOCUMENTS

| | | | |
|---|---|---|---|
| 5,108,287 | 4/1992 | Yee et al. | 206/379 |
| 5,190,154 | 3/1993 | Reusch | 206/375 |
| 5,515,249 | 5/1996 | Shiao . | |
| 5,535,882 | 7/1996 | Liu . | |
| 5,711,428 | 1/1998 | Ho | 206/372 |

FOREIGN PATENT DOCUMENTS

| | | |
|---|---|---|
| 0385055 | 9/1990 | European Pat. Off. . |
| 0476343 | 3/1992 | European Pat. Off. . |
| 0559105 | 9/1993 | European Pat. Off. . |
| 8902475 | 5/1989 | Germany . |
| 9205315 | 6/1992 | Germany . |
| 9416462 | 2/1995 | Germany . |
| 9403314 | 4/1995 | Germany . |

*Primary Examiner*—Paul T. Sewell
*Assistant Examiner*—Luan K. Bui
*Attorney, Agent, or Firm*—Martin A. Farber

[57] ABSTRACT

The invention relates to a storage device (1) for screwdriver bits (13) or the like and a chuck (20) therefor in a compartment, in which the screwdriver bits (13) with their clamping shafts inserted in pockets and the chuck (20) having a head (21) with an insertion aperture can be removed after the storage device has been opened. To provide a construction which is easy to use and promotes sales, the invention proposes that, with the storage device (1) closed, the operative ends (14) of the screwdriver bits (13) and the head (21) of the chuck (20) be exposed to the outside.

12 Claims, 4 Drawing Sheets

VII
VIII
VI
L
B
D
S

STORAGE DEVICE FOR SCREWDRIVER BITS OR THE LIKE AND CHUCK THEREFOR

FIELD AND BACKGROUND OF THE INVENTION

The invention relates to a storage device for screwdriver bits or the like and for a chuck for the bits to be held in a compartment, the screwdriver bits with their clamping shafts inserted in pockets and the chuck having a head with an insertion aperture being removable after the storage device has been opened.

In a known embodiment, the storage device comprises two housing portions which accommodate the screwdriver bits and the chuck. One of the housing portions defines a cover, so that when storage device is closed, the screwdriver bits and the chuck are removed from sight. It is thus impossible to recognize the nature of the screwdriver bits and the chuck from outside. Such a storage device also turns out to be non-sales-promoting, in particular if the storage device is accommodated in a transparent packaging, even though the storage device can be seen.

SUMMARY OF THE INVENTION

It is an object of the invention to provide a storage device of introductory mentioned type having a construction which is easy to use and promotes sales.

According to the invention, a storage device is provided wherein, in the closed state, the operative ends of the screwdriver bits and the head of the chuck are exposed to the outside.

As a result of this, there is provided a storage device of the present type which is of increased utility value. In order to observe the contents of the storage device, it is not necessary to open the device. The operative ends of the screwdriver bits are now stored in such a way that they can be seen by the observer or the user. This holds good also for the head of the chuck. The observer or the user recognizes of what kind are the screwdriver bits and the chuck. Furthermore, it is clear as to whether the storage device accommodates the appropriate number of screwdriver bits. Moreover, the construction according to the invention is sales-promoting. If the storage device is accommodated in a transparent packaging sleeve, the observer may likewise determine the nature of the contents of the storage device. In addition, the storage device is formed so that in the closed state, the screwdriver bits and the chuck remain in their prescribed position.

Further according to the invention, a storage device is provided in which the free space is open to both broad faces of the second housing portion and, in the pivoted-in state, accommodates the pivoting bar to fill the whole free space and in that a complementary free space of the second housing portion, which, in the pivoted-in state, adjoins the mouth openings of the receiving pockets and serves to accommodate the operative ends, is open to a broad face towards the front end of the second housing portion. On account of the free space open to both broad faces of the second housing portion, which free space accommodates the pivoting bar to fill the whole free space, there is realized a particularly low overall height of the storage device, associated with a reduced space requirement, for example in regard to transport and distribution, as also when offering for sale. Furthermore, material requirements are also kept low by this means, so that altogether, the manufacture of a storage device of this kind is associated with low costs. The free space which is open to both broad faces then permits the pivoting bar to be taken hold of directly when the pivoting bar is pivoted out into the position of use, for example by the thumb or index finger of an actuating hand. Moreover, in the pivoted-in state, it is apparent to the user which receiving pockets of the pivoting bar are occupied and of what kind are the operative ends. The operative ends are accommodated in the complementary free space of the second housing portion which adjoins the receiving pockets and the operative ends can therefore be seen by to the user. In addition, the complementary free space is matched to the length of the operative ends protruding beyond the receiving pockets, so that, in the pivoted-in state, the tools or the screwdriver bits remain in the receiving pockets as specified.

With regard to usage, it proves advantageous for the receiving pockets to have a radial spacing from the pivot axis. The pivoting bar is also formed accordingly. A relatively large lever arm is provided, which facilitates the pivoting out and pivoting in of the pivoting bar.

Furthermore, it proves advantageous to provide an insertion aperture parallel to the pivot axis and disposed between the latter and the receiving pockets, which insertion aperture connects with a recess which is open to an edge surface and to a broad side surface, in front of which insertion aperture, in the pivoted-in state, there comes, in axial extension, a part region of the second housing portion. The free space present between the pivot axis and the receiving pockets is thus used to accommodate an insertion aperture as well as a recess which is open to an edge surface and to a broad side surface. The insertion aperture serves to accommodate a shaft and the recess serves to accommodate a head of a chuck. In the pivoted-in state of the pivoting bar, the part region of the second housing portion extends in front of the recess and thus serves to secure the axial position of the chuck. The chuck is used, for example, to accommodate the polygonal clamping shaft of a screwdriver bit. The recess which is open to the broad side surface then gives an indication to the user as to whether or not a chuck is present in the storage device. If an insertion hole is provided, in the facing part region, in flush alignment with the insertion aperture, a screwdriver bit may also be inserted into the chuck when the storage device is closed. When there is a positive connection between the insertion aperture and the shaft of the chuck, the storage device may then even be used as an actuating handle.

It is further to be emphasized that in an acute-angled pivoted-open position, the tools inserted in the receiving pockets are removable, and a chuck having its shaft inserted in the insertion aperture and its receiving head of greater diameter engaged in the recess is removable only in a pivoted-open position of greater angle, in particular a right-angled pivoted-open position. While an acute-angled pivoted-open position of the pivoting bar is sufficient for the purpose of removing the screwdriver bits, in that the operative ends have left the complementary free space, the removal of the chuck, however, requires a pivoted-open position of greater angle or a right-angled pivoted-open position. Only then is the chuck no longer covered by the part region of the second housing portions which allows the subsequent withdrawal or alternatively insertion of the chuck.

A further advantageous feature of the invention consists in the thickness of the pivoting bar corresponding to the thickness of the second housing portion. In the pivoted-in state, the broad side surfaces of both housing portions are accordingly aligned with one another, which also proves to be very favorable visually.

Furthermore, it is provided that the diameter of the receiving head of the chuck be greater than the thickness of the pivoting bar. This is possible because of the corresponding formation of the recess of the pivoting bar which is open to the broad side surfaces. Naturally, chucks having a receiving head of smaller diameter may also be stored by the pivoting bar.

So that on pivoting-in of the pivoting bar, the bar does not pivot out of the free space, the free space provides at least one lateral pivot-limiting-stop.

For the purpose of securing the pivoted-in state of the pivoting bar, there serve latching means disposed in the region of the separating joint extending parallel to the axis, which latching means come into engagement in the pivoted-in stop position.

Finally, an advantageous feature is also to be seen in that the complementary free space has limiting fins which penetrate into it, for the purpose of axially securing the inserted tools.

BRIEF DESCRIPTION OF THE DRAWINGS

With the above and other objects and advantages in view,the present invention will become more clearly understood in connection with the detailed description of preferred embodiments, when considered with the accompanying drawings of which.

DETAILED DESCRIPTION OF THE PREFERRED EMBODIMENTS

Figure 1:
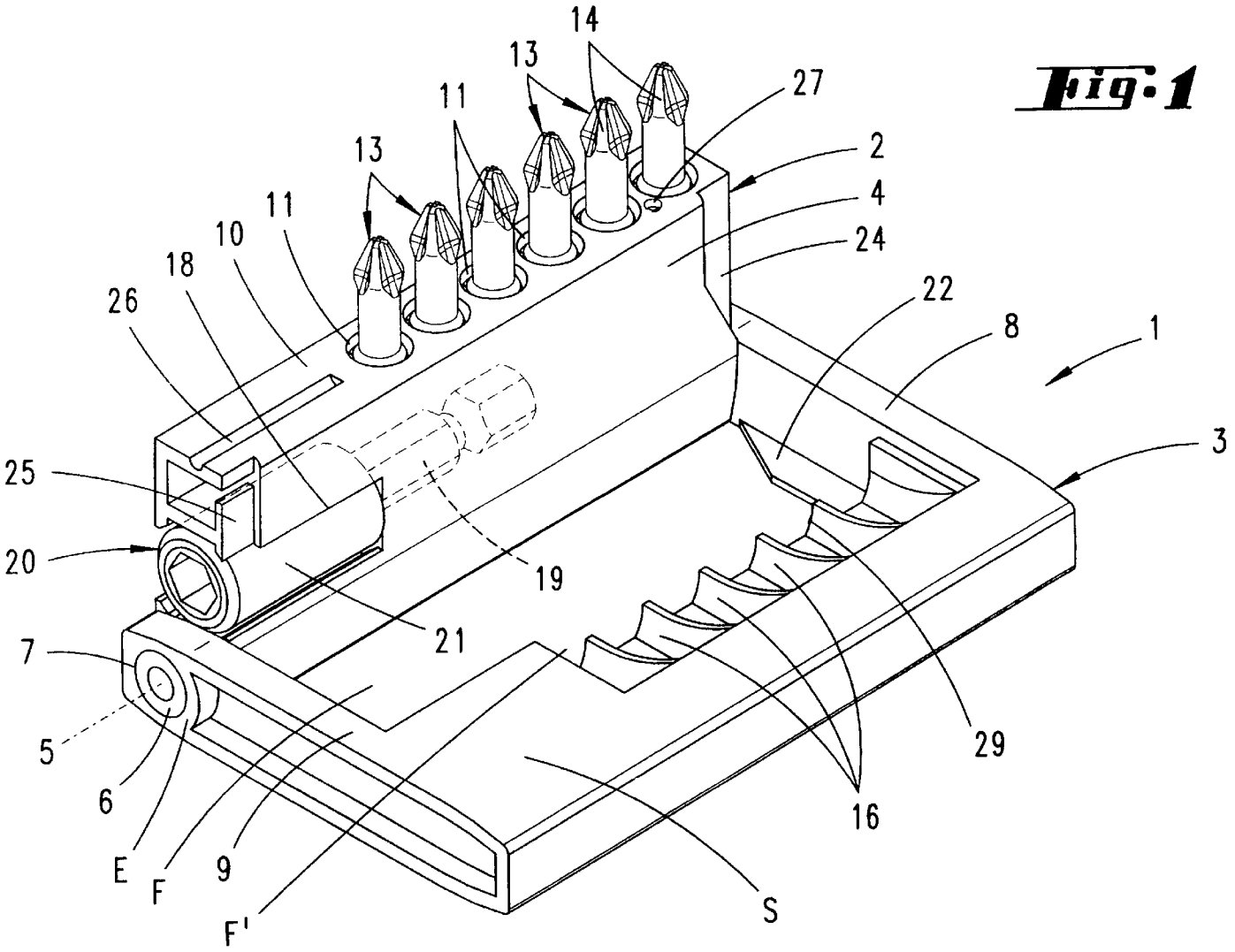
FIG. 1 shows in perspective representation, a storage device formed according to the invention according to the first embodiment, with the pivoting bar accommodating the tools pivoted out.

According to the first embodiment of the storage device 1 illustrated in FIGS. 1 to 9, the device has a first housing portion 2 and a second housing portion 3. The first housing portion 2 forms a pivoting bar 4 in such a way that the pivot axis 5 is located between the housing portions 2, 3, respectively in the housing-portion end regions E and E'. In the pivoted-in state of the pivoting bar 4, there is provided a shape of the storage device 1 which is rectangular in plan view, so that the length L of the storage device is greater than its width.

For the purpose of defining the pivoting axis 5, there are formed, on the housing-portion end regions E', hollow pins 6 which penetrate into bearing recesses 7 of the housing-portion end regions E of the second housing portion 3.

Seen in plan view, the second housing portion 3 is formed U-shaped, so that the U-shaped arms define part regions 8, 9 which have the bearing recesses 7 at their ends. The interior of the U-shape accordingly defines a free space F which is open to both broad faces of the second housing portion 3, for the purpose of accommodating the pivoted-in pivoting bar 4 which fills the whole free space.

From the narrow side face 10 of the pivoting bar 4 which extends parallel to the pivot axis 5, there extend receiving pockets 11 which are like blind holes. Into each receiving pocket 11, there may be inserted the clamping shaft 12, of hexagonal shape in cross-section, of a screwdriver bit 13 forming the tool, in such a way that the operative end 14 protrudes beyond the receiving pocket 11 and the mouth opening of the pocket. The receiving pockets 11 are arranged row-like, one after the other, but are disposed over only a part length of the narrow side face 10. In the pivoted-in state of the pivoting bar 4, there is provided, adjacent to the mouth openings of the receiving pockets 11, a complementary free space F' of the second housing portion 3 which serves to accommodate the operative ends 14. This complementary free space is open to the broad face S on the front side of the second housing portion 3. Limiting fins 15 are associated with the complementary free space F'. These limiting fins may project into the complementary free space F', or the complementary free space may be terminated by the limiting fins. In a pivoted-in state of the pivoting bar 4, a fin 15 is disposed centrally opposite each operative end 14, so that the tools or screwdriver bits 13 are secured in position in the axial direction. Furthermore, there extend, parallel to the limiting fins 15, separating fins 16, which extend up to the free space F and separate the operative ends 14 from one another.

Figures 2, 3, 4, 5, 6:
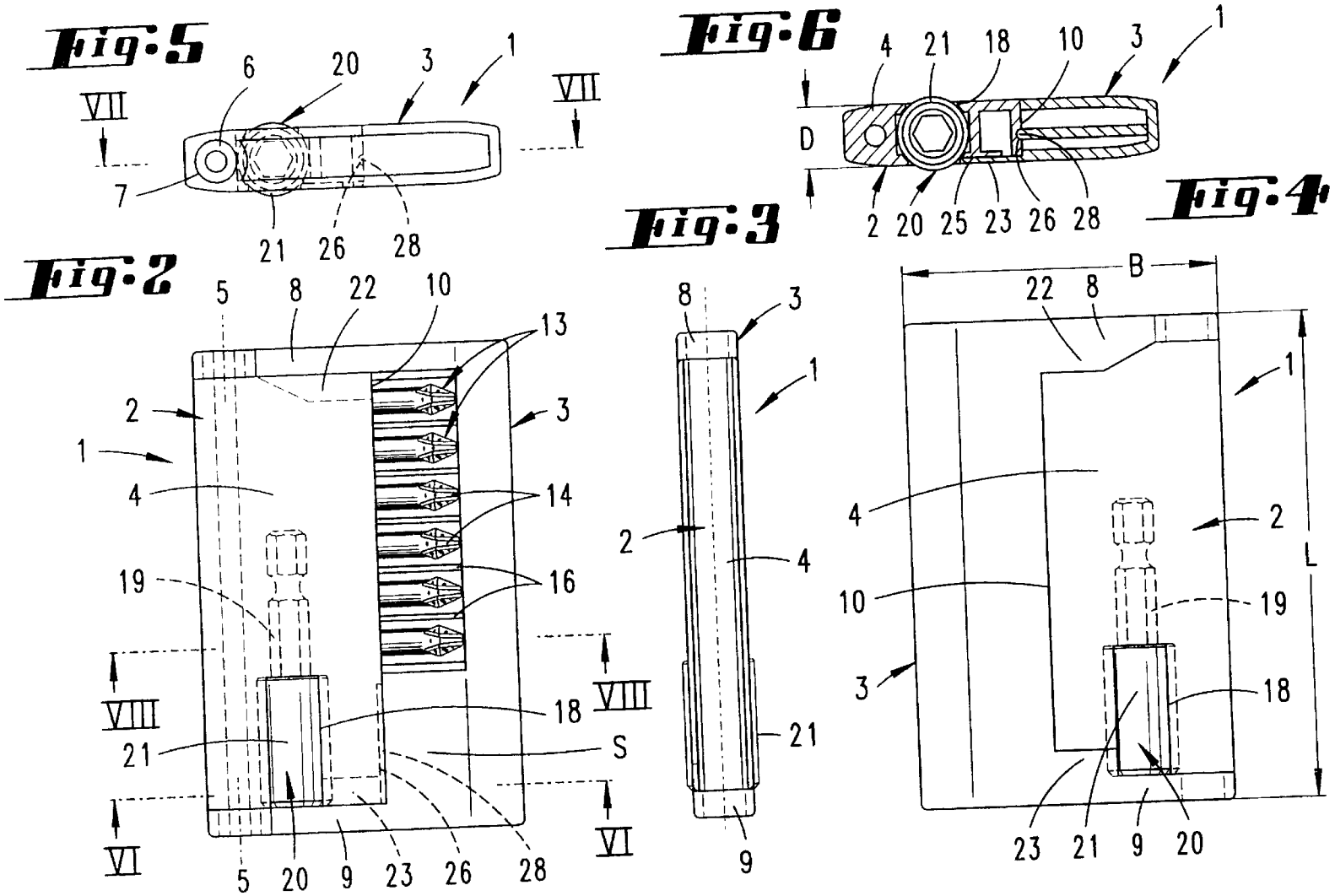
FIG. 2 shows a plan view of the closed storage device with a view of the operative ends of the tools entered into the complementary free space.
FIG. 3 shows the edge representation of FIG. 2.
FIG. 4 shows a back view of the storage device.
FIG. 5 shows the end edge representation of the storage device, proceeding from FIG. 2.
FIG. 6 shows the section on the line VI—VI in FIG. 2.
Figure 7:
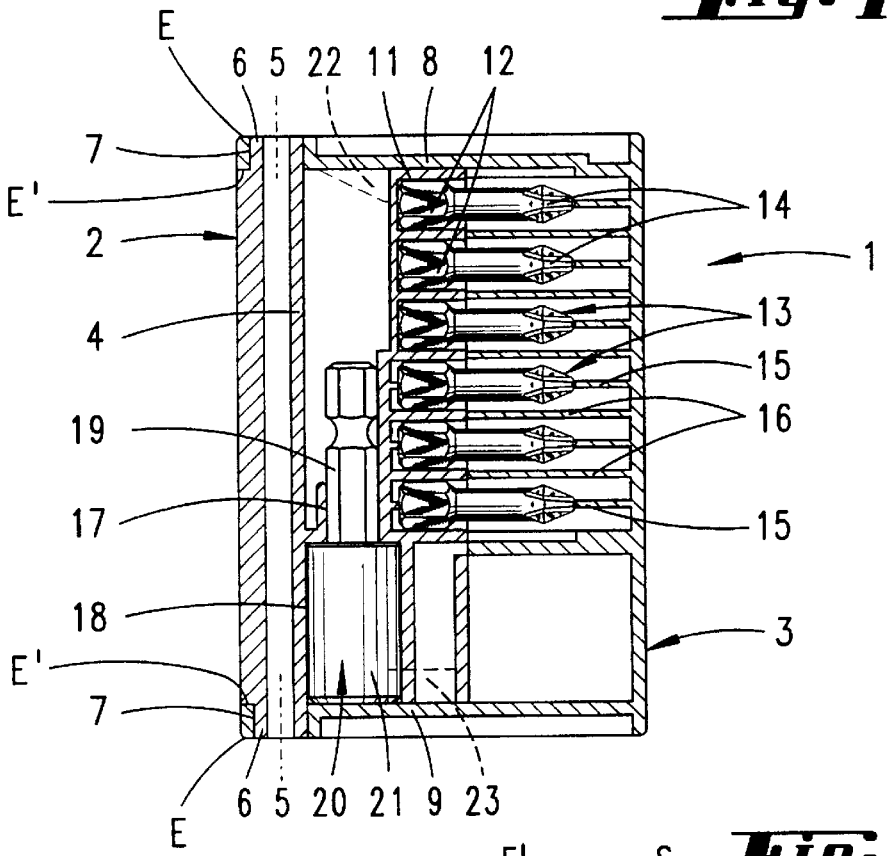
FIG. 7 shows the section on the line VII—VII in FIG. 5.
Figure 8:
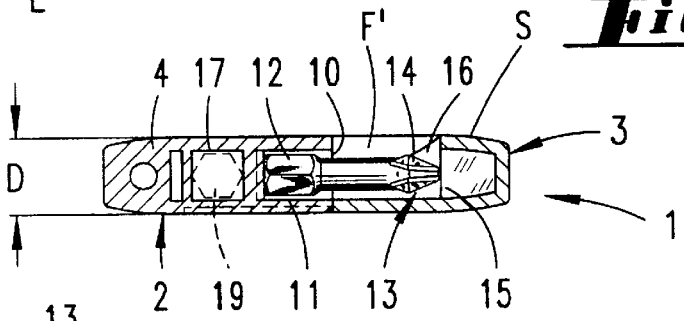
FIG. 8 shows the section on the line VIII—VIII in FIG. 2.
Figure 9:
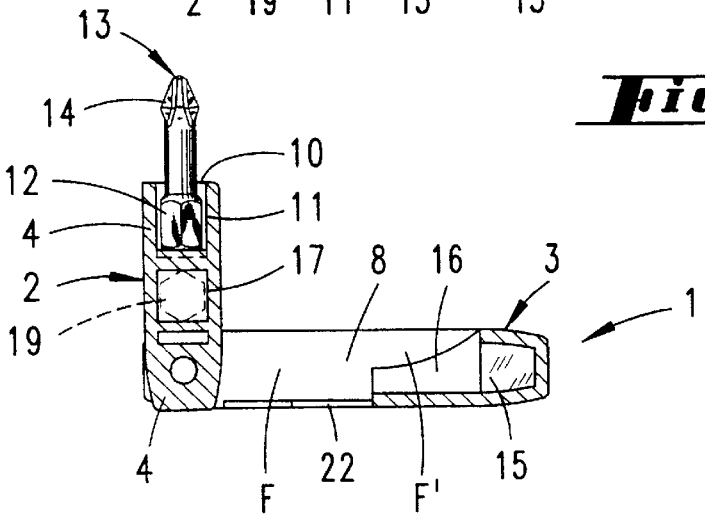
FIG. 9 shows a section corresponding to FIG. 8, but with the pivoting bar pivoted out into the withdrawal position.

As illustrated in FIGS. 6 and 8 in particular, the thickness D of the pivoting bar 4 corresponds to the thickness of the second housing portion 3. This means that in pivoted-in state, the broad side surfaces of the first housing portion 2 and of the second housing portion 3 are in alignment with one another. Between the pivot axis 5 and the receiving pockets 11 provided at a radial spacing from the pivot axis 5, there is disposed an insertion aperture 17 extending parallel to the pivot axis. Insertion aperture 17 connects with a recess 18 which is open to the edge surface and to a broad side surface. This recess ends close to the first receiving pocket 11, facing the recesses, of the receiving pockets arranged a row. In pivoted-in state of the pivoting bar 4, the axial part region 9 of the L second housing portion 3 is disposed in front of the insertion aperture 17 and the recess 18, see FIG. 7 in particular in this regard. The insertion aperture 17 serves to accommodate a shaft 19 of a chuck 20 illustrated by dot-dash lines, whose receiving head 21, which is greater in diameter than the shaft 19, is inserted in the recess 18. As FIGS. 5 and 6 illustrate, the receiving head 21 may have a diameter which is greater than the thickness D of the pivoting bar 4.

So that on pivoting-in of the pivoting bar 4, the bar does not pivot through the free space F, there extends, from each of the side regions 8, 9, a lateral pivot-limiting-stop 22 and 23 respectively. Corresponding to the plan view shape of the limiting stops 22, 23, the pivoting bar 4 is provided with recesses 24 and 25 respectively on the corresponding broad side surface, so that in the pivoted-in state of the pivoting bar 4, the limiting stops 22, 23 engage snugly in these recesses 24, 25.

For the purpose of securing the pivoted-in position of the pivoting bar 4, latching means are disposed in the region of the separating joint extending parallel to the pivot axis 5. On the one hand, this means is a latching groove 26 disposed on the narrow face surface 10, which latching groove extends approximately over the length of the recess 18. Furthermore, on this narrow face surface, there is provided a latching hole 27 at a spacing from the latching groove 26. The latching groove 26 cooperates with a latching ridge 28 which projects into the free space F. The latching hole 27 receives, on a separating fin 16, a latching peg 29.

When the storage device 1 is closed, the operative ends 14 of the screwdriver bits 13 are visible to the user. This holds good also for the chuck 20. In order to remove one or more screwdriver bits 13, the pivoting bar 4 is to be pivoted, with release of the latching means, into the position illustrated in FIGS. 1 and 9, in which position the part region 9 does not block the recess 18 and does not block removal of the chuck 20 engaged in the recess. The chuck may be pulled out of the insertion aperture 17 and may serve to accommodate a screwdriver bit 13 removed from the receiving pocket 11.

The removal of a screwdriver bit 13 only may also be effected in an acute-angled pivoted-open position. In such a position, the chuck 20 would not be free for removal.

The receiving pockets 11 may be dimensioned so that the clamping shafts 12 of the screwdriver bits 13 are held frictionally engaged. Likewise, a frictional engagement may be provided between shaft 19 and insertion aperture 17.

Figure 11:
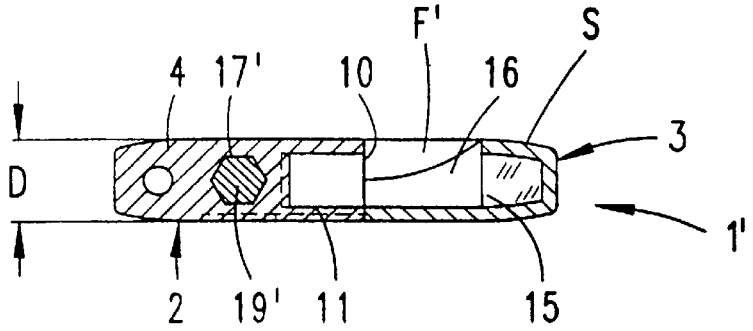
FIG. 11 shows the section on the line XI—XI in FIG. 10.
Figure 10:
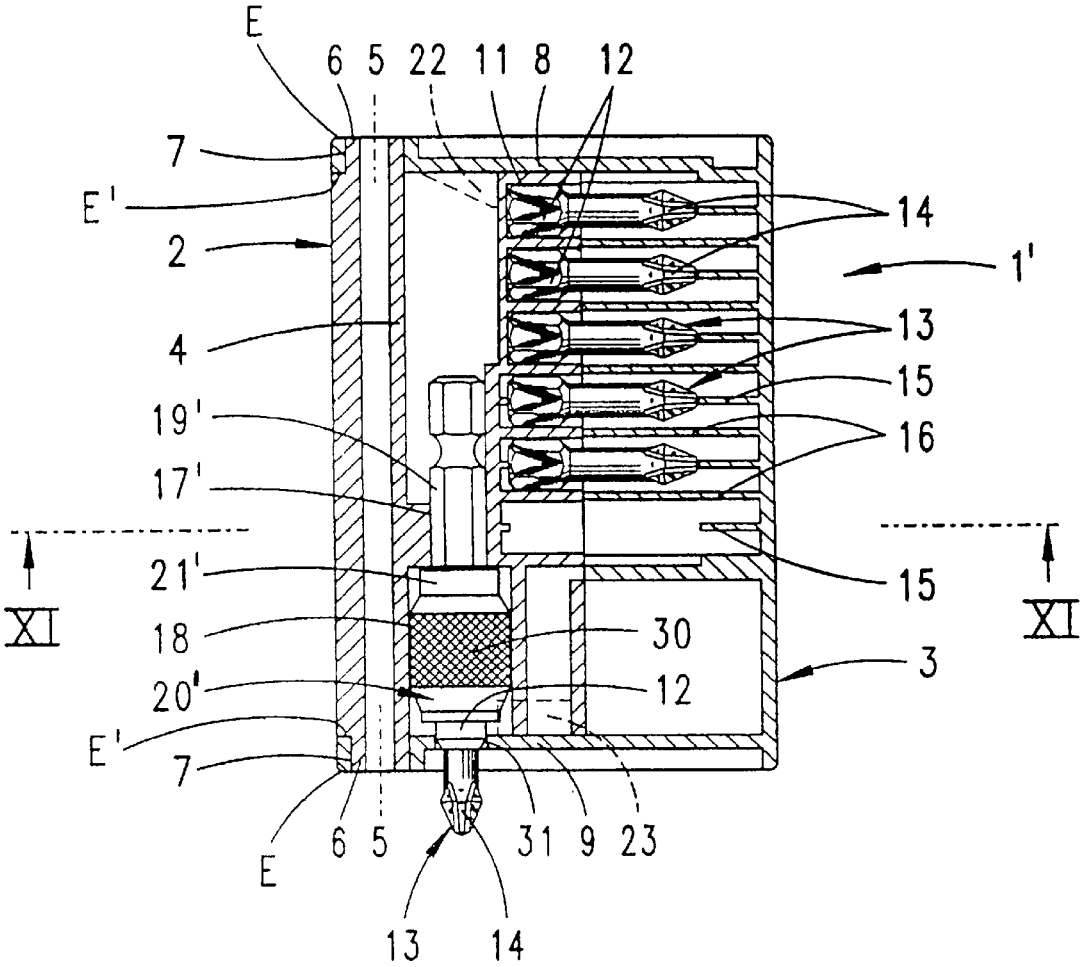
FIG. 10 shows a section corresponding to FIG. 7, according to the second embodiment, in which, as a variant, when the storage device is closed, a screwdriver bit is inserted into the chuck accommodated by the storage device.

According to the second embodiment of the storage device 1' represented in FIGS. 10 and 11, identical components have the same reference numerals. By way of variant, the chuck 20' is now formed as a quick change chuck. Its shaft 19' is accommodated positively by the insertion aperture 17'. That means that shaft 19' and insertion aperture 17' are formed to be identical in cross section. A spring-loaded actuating sleeve 30 is associated with the receiving head 21'. When the head is displaced in a direction facing opposite the shaft, a screwdriver bit 13 may be inserted into the chuck 20'.

The tooling of the chuck may be effected when the chuck 20' is accommodated by the storage device 1'. For this purpose, the part region 9 has a hole 31 in a position of alignment with the insertion aperture 17'. The hole is dimensioned sufficiently large for it to be possible for the clamping shaft 12 of the screwdriver bit 13 to be guided through the hole. When the actuating sleeve 30 is displaced, the screwdriver bit can then be inserted into the position illustrated in FIG. 10. At the same time, the screwdriver bit then assures the closed position of the storage device 1'. On account of the positive engagement between the shaft 19' of the chuck 20' and the insertion aperture 17' of the pivoting bar 4, the storage device 1' may serve as handle, so as to enable, for example, screwing-in or unscrewing of a screw.

The opening of the storage device 1' necessitates removal of the screwdriver bit inserted in the chuck 20'.

We claim:

1. An openable and closeable storage device adapted for and to be used in combination with screwdriver bits and a chuck, for the bits, to be held in the storage device, the storage device comprising a first housing portion pivotably mounted on a second housing portion, pivotable from open conditions into a closed condition with said housing portions in a complementary interengaging position of minimum space, at least one of the housing portions formed such that the screwdriver bits with their clamping shafts being insert able in pockets of the storage device and the chuck having a receiving head being insertable in a recess of the storage device are removable respectively from said pockets and said recess only after the storage device has been opened into an open condition, wherein, the housing portions formed such that in the closed condition of the housing portions of the storage device with said screwdriver bits and said chuck inserted in said pockets and said recess, respectively, operative ends of the screwdriver bits and the receiving head of the chuck are open to, being exposed to outside of the storage device through open regions in broad faces of the storage device, and a diameter of the receiving head of the chuck is greater than the thickness of the storage device and said recess is open to said broad surfaces and to an edge surface of the storage device.

2. A storage device for screwdriver bits having shafts and operative ends respectively and for a chuck having a chuck shaft, and an operative end of the chuck, the storage device comprising.

a first housing portion which forms a pivoting bar, a second housing portion defining a first free space, a complementary free space, and front and back broad faces, the Pivoting bar engaging pivotably at both ends of the bar in said second housing portion and, in a pivoted-in state constituting a final closed position of said housing portions, merely pivoted into said first free space of the second housing portion spaced apart from said second housing portion adjacent said complementary free space, a pivot axis being disposed respectively in end regions of said housing portions, and the pivoting bar having receiving pockets extending from a narrow face of the pivoting bar, said receiving pockets extending transversely to the pivot axis, and adapted for receiving therein the shafts of the screwdriver bits, the receiving pockets at free ends thereof in said narrow face having mouth openings, respectively, and the receiving pockets being such that said operative ends of the screwdriver bits project out of the mouth openings when said shaft of said screwdriver bits are inserted into said receiving pockets, and in the pivoted-in state, a part region of the second housing portion being disposed at an axial spacing in front of the receiving pockets, and wherein the first free space is open through both said broad faces of the second housing portion and, in the pivoted-in state, said first free space receives the pivoting bar filling all of said first free space, and said complementary free space of the second housing portion in the pivoted-in state adjoins the mouth openings of the receiving pockets and is adapted to receive the operative ends of the screwdriver bits when said shafts of said screwdriver bits are fully inserted into said receiving pockets, and said complementary free space remaining open, exposing the operative ends of the bits, to said front broad face towards a front end of the second housing portion with said narrow face of said pivoting bar having said mouth openings on said first housing portion adjacent said mouth openings and said complementary free space being spaced apart from said second housing portion in said pivoted-in closed position of said housing portions.

3. A storage device according to claim 2, wherein the receiving pockets have a radial spacing from the pivot axis.

4. A storage device according to claim 2, wherein the thickness of the pivoting bar corresponds to the thickness of the second housing portion.

5. A storage device according to claim 2, wherein on said second housing portion there extends in the first free space at least one lateral pivot-limiting-stop.

6. A storage device according to claim 2, further comprising limiting fins on said second housing portion, said limiting fins penetrate into the complementary free space, axially abuttingly securing the screwdriver bits when said shafts of said screwdriver bits are fully disposed in said receiving pockets in said pivoted-in state.

7. A storage device for screwdriver bits having shafts and operative ends respectively and for a chuck having a chuck shaft, and an operative end of the chuck, the storage device comprising a first housing portion which forms a pivoting bar, a second housing portion defining a first free space, complementary free space, and front and back broad faces, the pivoting bar engaging pivotably at both ends of the bar in said second housing portion and, in a pivoted-in state, pivoting into said first free space of the second housing portion, a pivot axis being disposed respectively in end regions of said housing portions, and the pivoting bar having receiving pockets extending transversely to the pivot axis and adapted for receiving therein the shafts of the screwdriver bits, the receiving pockets at free ends thereof having mouth openings, respectively, and the receiving pockets being such that said operative ends of the screwdriver bits project out of the mouth openings when said shaft of said screwdriver bits are inserted into said receiving pockets, and in the pivoted-in state, a dart region of the second housing portion being disposed at an axial spacing in front of the receiving pockets, and wherein the first free space is open through both said broad faces of the second housing portion and, in the pivoted-in state, said first free space receives the pivoting bar filling all of said first free space, and said complementary free space of the second housing portion in the pivoted-in state adjoins the mouth openings of the receiving pockets and is adapted to receive the operative ends of the screwdriver bits when said shafts of said screwdriver bits are inserted into said receiving pockets, and said complementary free space is open to said front broad face towards a front end of the second housing portion, insertion aperture in said pivoting bar parallel to the pivot axis and disposed between the pivot axis and the receiving pockets, said insertion aperture connects with a recess in said pivoting bar which recess is open to an edge surface and to a broad surface of said pivoting bar, and in front of said insertion aperture, in the pivoted-in state, there is, in axial extension, a part region of the second housing portion.

8. A storage device according to claim 7, wherein in an acute-angled pivoted-open position of said housing portions, the screwdriver bits, when the shafts thereof are disposed in the receiving pockets, are removable, and the chuck is adapted to have said chuck shaft inserted in the insertion aperture, and a receiving head of said chuck, of greater diameter than that of said chuck shaft, engaged in the recess, and said chuck is removable only in a pivoted-open position of greater angle than that of said acute-angled pivoted-open position.

9. A storage device according to claim 8, wherein the diameter of the receiving head is greater than the thickness of the pivoting bar.

10. A storage device according to claim 8, wherein said pivoted-open position of greater angle than that of said acute-angled pivoted-open position is a right-angled pivoted-open position of said housing portions.

11. A storage device for screwdriver bits having shafts and operative ends respectively and for a chuck having a chuck shaft, and an operative end of the chuck, the storage device comprising a first housing portion which forms a pivoting bar, a second housing portion defining a first free space, a complementary free space, and front and back broad faces, the pivoting bar engaging pivotably at both ends of the bar in said second housing portion and, in a pivoted-in state, pivoting into said first free space of the second housing portion, a pivot axis being disposed respectively in end regions of said housing portions, and the pivoting bar having receiving pockets extending transversely to the pivot axis and adapted for receiving therein the shafts of the screwdriver bits, the receiving pockets at free ends thereof having mouth openings, respectively, and the receiving pockets being such that said operative ends of the screwdriver bits project out of the mouth openings when said shaft of said screwdriver bits are inserted into said receiving pockets, and in the pivoted-in state, a part region of the second housing portion being disposed at an axial spacing in front of the receiving pockets, and wherein the first free space is open through both said broad faces of the second housing portion and, in the pivoted-in state, said first free space receives the pivoting bar to filling all of said first free space, and said complementary free space of the second housing portion in the pivoted-in state adjoins the mouth openings of the receiving Rockets and is adapted to receive the operative ends of the screwdriver bits when said shafts of said screwdriver bits are inserted into said receiving pockets, and said complementary free space is open to said front broad face towards a front end of the second housing portion, and latching means disposed in a region of a separating joint extending parallel to the pivot axis.

12. A storage device according to claim 11, wherein said latching means comprises a latching groove on said pivoting bar, said groove extending parallel to said pivot axis, and a latching ridge on said second housing part releasably engageable on said latching groove.

* * * * *